175-50 SR
7/16/85 XR 4,529,036

United States Patent [19]
Daneshy et al.
[11] Patent Number: 4,529,036
[45] Date of Patent: Jul. 16, 1985

[54] METHOD OF DETERMINING SUBTERRANEAN FORMATION FRACTURE ORIENTATION

[75] Inventors: Abbas A. Daneshy, Duncan, Okla.; Pat T. Chisholm, Portland, Tex.; Dan A. Magee, Robstown, Tex.; Gary L. Slusher, Robstown, Tex.

[73] Assignees: Halliburton Co, Duncan, Okla.; Berry Cox; Edwin Cox, both of Tex.

[21] Appl. No.: 641,535

[22] Filed: Aug. 16, 1984

[51] Int. Cl.[3] ..... E21B 43/26; E21B 47/02; E21B 49/02

[52] U.S. Cl. ..... 166/254; 166/250; 166/306; 166/308; 73/155; 175/50; 175/58

[58] Field of Search ..... 166/250, 254, 259, 271, 166/306, 308; 73/155; 175/44, 48, 50, 58

[56] References Cited

U.S. PATENT DOCUMENTS

| | | | |
|---|---|---|---|
| 1,572,748 | 2/1926 | Mitchell | 166/250 X |
| 2,974,739 | 3/1961 | Dean | 175/44 X |
| 3,739,871 | 6/1973 | Bailey | 166/250 X |
| 3,878,884 | 4/1975 | Raleigh | 166/308 X |
| 4,044,828 | 8/1977 | Jones et al. | 166/250 X |
| 4,192,182 | 3/1980 | Sylvester | 166/271 X |
| 4,415,035 | 11/1983 | Medlin et al. | 166/250 X |
| 4,442,895 | 4/1984 | Lagus et al. | 166/250 |
| 4,474,250 | 10/1984 | Dardick | 175/50 X |

*Primary Examiner*—George A. Suchfield
*Attorney, Agent, or Firm*—Robert A. Kent; Thomas R. Weaver

[57] ABSTRACT

A method of determining the orientation of a fracture or fractures created in a subterranean formation penetrated by a wellbore is provided. The method comprises creating a fracture in the formation extending from a lower end portion of the wellbore and then removing a location orientated core containing a portion of the fracture from the wellbore to thereby determine the orientation of the fracture in the formation.

20 Claims, 5 Drawing Figures

METHOD OF DETERMINING SUBTERRANEAN FORMATION FRACTURE ORIENTATION

BACKGROUND OF THE INVENTION

1. Field of the Invention

The present invention relates generally to a method of determining subterranean formation fracture orientation, and more particularly, but not by way of limitation, to a method of determining fracture orientation wherein a fracture is created in a formation and a location orientated core containing a portion of the fracture is removed therefrom.

2. Description of the Prior Art

In the production of fluids such as oil, gas and water from a subterranean rock formation penetrated by a wellbore, a commonly used technique for stimulating the production of fluids from the formation is to create and extend fractures therein. Most often, the fractures are created by applying hydraulic pressure on the formation from the wellbore. That is, a fluid is pumped through the wellbore and into the formation to be fractured at a rate such that the resultant hydraulic force exerted on the formation causes one or more fractures to be created therein. The fractures are extended by continued pumping, and the fractures are usually propped open after being formed and extended so that fluids contained in the formation readily flow through the fractures into the wellbore. Fracturing techniques are also used in formations penetrated by injection and production wells which are utilized for carrying out enhanced production procedures therein, e.g., waterflood and other similar recovery procedures, as well as in other oilfield applications.

Subterranean rock formations are usually bounded by formations formed of dissimilar rock materials. Because of this, in carrying out fracture stimulation procedures in a formation from which it is desired to produce fluids, it is often necessary and always desirable to know the direction of the least in situ principal stress in each formation, i.e., the direction in which fractures will extend in the formation, as well as the relative levels of the least in situ principal stresses in the formations. For example, when the formation containing desired fluids is bounded by one or more formations containing undesired fluids, if it is known that the formation containing desired fluids has the lowest least in situ principal stress level, then fractures can be created and extended in that formation without fear of fracturing the formations containing undesired fluids. If the converse situation exists and is known, a production stimulation procedure other than one involving fracturing can be utilized.

In a given field containing a reservoir of desired fluids, it is desirable to know the orientation of fractures induced in formations containing the fluids so that the drilling of wellbores into the formations and the production of fluids therefrom can be optimized and maximum production obtained. In other operations such as in carrying out enhanced production procedures and solution mining procedures where communication between wellbores is required, a knowledge of the orientation of induced fractures is essential to bringing about such communication.

By the present invention a method of determining induced fracture orientation, i.e., the direction of the least in situ principal stress, in one or more subterranean formations is provided. The fracture orientation information obtained can be utilized to determine if fracture techniques should be carried out in the formations, where other wellbores should be drilled, which of two or more formations has the lowest least in situ principal stress level and consequently will fracture first, and the like.

SUMMARY OF THE INVENTION

By the present invention, the orientation of fractures created in a subterranean formation penetrated by a wellbore is determined. A fracture is created in the formation extending from the lower end portion of the wellbore and a location orientated core containing a portion of the fracture is removed from the wellbore. The orientation of the fracture in the core is used to determine the orientation of the fracture in the formation.

After determining the orientation of a fracture created in a first subterranean formation, the method can be repeated to determine the orientation of fractures in one or more other formations and the least in situ principal stress levels in the formations can be determined.

It is, therefore, a general object of the present invention to provide a method of determining the orientation of fractures created in one or more subterranean formations.

A further object of the present invention is the provision of a method for determining the orientation of fractures created in two or more subterranean formations as well as the least in situ principal stress levels of the formations and other information during the drilling of a wellbore penetrating the formations.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

The drilling of wellbores penetrating subterranean formations is most commonly carried out using a string of drill pipe having a drill bit attached to the lower end. The drill pipe and drill bit are rotated while drilling fluid is circulated from the surface through the drill pipe and drill bit into the wellbore and then upwardly through the annulus between the wellbore and drill pipe back to the surface. The drilling fluid lubricates the drill bit and carries cuttings to the surface for separation therefrom.

In carrying out the method of the present invention for determining the orientation of fractures created in a subterranean formation during the drilling of a wellbore penetrating the formation, the wellbore is drilled to a point within the formation. That is, the wellbore is drilled into the formation but not through the formation. The string of drill pipe and drill bit are removed from the hole, a conventional open hole packer is connected to the lower end of the drill pipe and the packer and drill pipe are lowered in the wellbore to a point whereby a lower end portion of the wellbore within the formation remains below the packer. The packer is then set so that the lower end portion of the wellbore is isolated from the annulus between the wellbore and the string of drill pipe above the packer.

Figure 1:
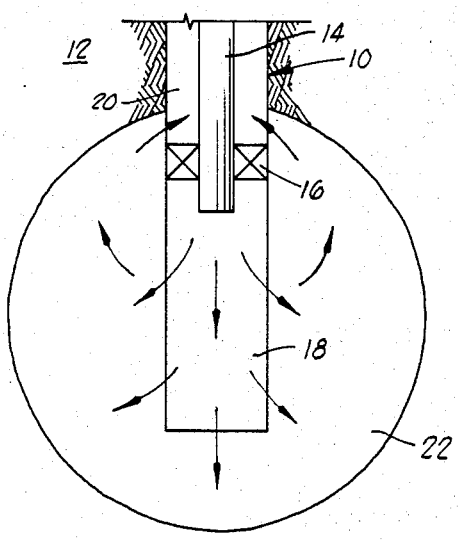
FIG. 1 is a diagrammatic illustration of the lower end portion of a wellbore penetrating a subterranean formation just after a fracture has been formed in the formation.

Referring now to FIG. 1, the lower portion of a wellbore 10 penetrating a subterranean formation 12 is illustrated. A string of drill pipe 14 is disposed in the wellbore 10 and an open-hole packer 16 is positioned in the wellbore 10 so that a lower end portion 18 of the wellbore within the formation 12 remains below the packer. As illustrated, the drill string 14 extends through the packer 16 and terminates therebelow so that fluids introduced into the wellbore 10 by way of the drill string 14 are prevented by the packer 16 from flowing within the wellbore into the annulus 20 between the wellbore and the drill string. While the lower end of the drill string 14 is shown in FIG. 1 positioned just below the packer 16, the drill string 14 can extend into the lower end portion 18 of the wellbore 10 and can extend to the bottom of the wellbore if desired.

After the packer 16 has been set in the wellbore 10, its sealing ability can be tested by pressuring up the annulus 20 above the packer and then pressuring up the lower end portion 18 of the wellbore below the packer to a higher pressure level than the pressure level in the annulus. If the annulus pressure does not increase while the higher pressure level in the wellbore below the packer is held at a substantially constant level, leakage around the packer is not taking place.

Upon setting and testing the packer 16, a fracturing fluid, most conveniently drilling fluid, is pumped through the drill string 14 into the lower end portion 18 of the wellbore 10 whereby hydraulic pressure is applied on the formation 12. The pumping rate and hydraulic force on the formation are increased to the level whereby a fracture 22 is created in the formation. The fracture 22 is generally vertical, as are most hydraulic pressure-induced fractures, and the pumping of the fracturing fluid is continued to extend the fracture in all directions from the lower end portion 18 of the wellbore 10 until communication between the lower end portion 18 and the annulus 20 occurs as shown by the arrows in FIG. 1. That is, when the fracture 22 extends in the formation 12 to a point above the packer 16, communication by way of the fracture between the lower end portion 18 and the annulus 20 takes place and a rise in the annulus pressure level will be noted. The total quantity of fracturing fluid required to be pumped into the lower end portion 18 of the wellbore 10 to create and extend the fracture 22 therein is usually quite small, e.g., in the range of from one to five barrels.

In a preferred technique, downhole pressure level recording instruments are placed in the wellbore 10 as a part of or with the packer 16 whereby the pressure below the packer in the lower end portion 18 of the wellbore 10, hereinafter referred to as the tubing pressure, and the pressure above the packer, i.e., the annulus pressure are continuously recorded. After evidence of the creation and extension of the fracture 22 has been obtained, the pumping of fluid into the lower end portion 18 of the wellbore 10 is terminated and the drill string 14 and wellbore 10 are shut in. The continuous recording of the tubing and annulus pressure levels after the shut-in (referred to in the art as the instantaneous shut-in pressure) provides information concerning the nature of the created fracture and the formation. Preferably, several sequences of pumping fluid into the lower end portion 18 of the wellbore 10 followed by shutting in the wellbore and tubing string are carried out at various pumping rates. If the annulus pressure level stabilizes as soon as pumping is stopped, the instantaneous closure of the fracture is indicated. To further determine fracture closure characteristics, the pressure level in the annulus 20 or the pressure level in the lower end portion 18 of the wellbore 10 can be reduced. If the fracture 22 is completely closed, the reduction of pressure in one of such locations will not cause the lowering of the pressure level in the other location.

During the carrying out of the procedures described above whereby fluid is pumped by way of the drill string 14 into the lower end portion 18 of the wellbore 10 and into the annulus 20 by way of the fracture 22, the pressure in the annulus may increase to a level whereby it is necessary to reduce the annulus pressure. This can be accomplished by flowing fluid out of the annulus by way of a surface valve connected thereto.

Once the fracturing and testing procedures described above have been carried out, the pressures in the annulus and in the lower end portion 18 of the wellbore 10 are relieved and the packer 16 is released from engagement with the walls of the wellbore. The packer 16 and drill string 14 are withdrawn from the wellbore and a conventional core cutting device capable of producing a location oriented core is lowered into the wellbore.

Figure 2:
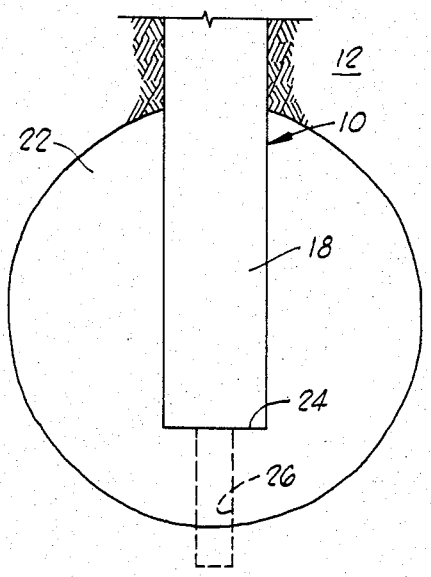
FIG. 2 is a diagrammatic illustration of the wellbore and formation of FIG. 1 showing the location of a core to be removed from the formation.

A variety of downhole coring techniques and apparatus have been developed whereby a portion of a selected downhole formation (known in the art as a core or core sample) is removed from the formation and taken to the surface while maintaining a knowledge of or ability to determine the location orientation of the sample. In accordance with the present invention, such an apparatus is utilized to obtain a location oriented core from the bottom of the wellbore 10. That is, the coring apparatus is utilized to cut and remove a vertical core sample 28 from the bottom 24 of the wellbore 10. The location from where the core sample 28 is removed is shown by dashed lines on FIG. 2 and is designated by the numeral 26.

Figure 3:
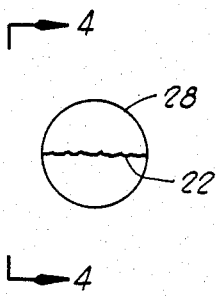
FIG. 3 is an enlarged top view of a core removed from a fractured formation.
Figure 4:
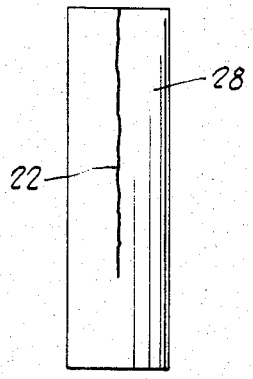
FIG. 4 is a side view of the core of FIG. 3 taken along line 4—4 of FIG. 3.

Referring now to FIGS. 3 and 4, the core sample removed from the bottom 24 of the wellbore 10 is illustrated and designated by the numeral 28. Because the vertical fracture 22 extends downwardly from the bottom 24 of the wellbore 10, the core sample 28 obtained thereform contains a portion of the fracture 22. As mentioned above, the core 28 is location orientated so that when the core 28 is brought to the surface, orientated with respect to its original location, and the orientation of the portion of the fracture 22 contained therein observed, the orientation of the fracture 22 within the formation 12 can be determined.

Once the orientation of the fracture 22 in the formation 12 has been determined, the string of drill pipe and drill bit are again lowered into the wellbore 10 and the wellbore 10 is deepened. If it is desirable to determine the orientation of fractures in additional formations penetrated by the wellbore 10, the procedure described above for determining the orientation of fractures are repeated therein including the recording of instantaneous shut-in pressures in each formation. A comparison of the recorded pressure level and other information will, in addition to fracture orientation, reveal differences in the least in situ principal stress levels in the formations. That is, the formation which fractures at the lowest pressure and/or produces the lowest instantaneous shut-in pressure will be the most fracturable and has the lowest least in situ principal stress level.

While the methods of this invention are particularly suitable for determining subterranean fracture orientation during the drilling of a wellbore, the methods can be carried out in a wellbore after drilling has been terminated or after the well has been completed using conventional tools, pumping equipment, conduit strings disposed in the wellbore, etc.

EXAMPLE

Figure 5:
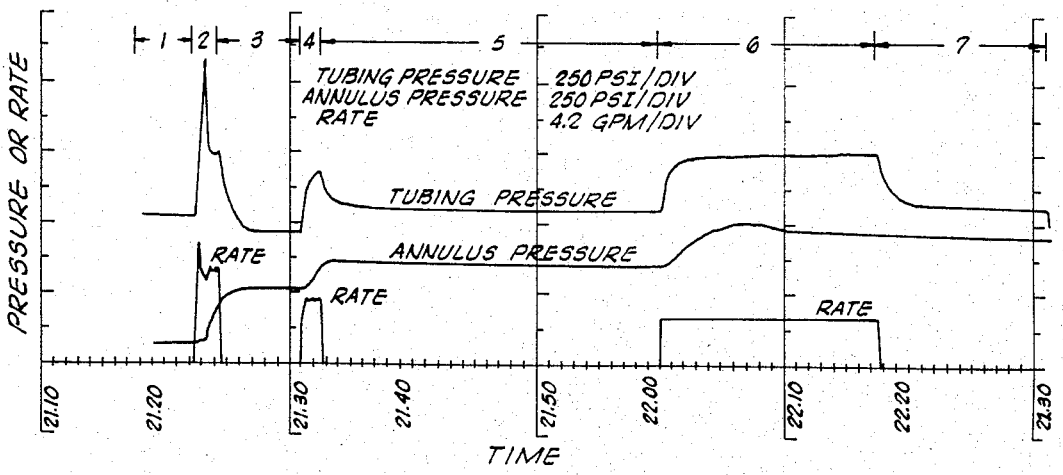
FIG. 5 illustrates a portion of a typical fracturing chart illustrating a fracturing procedure carried out in accordance with the present invention.

Referring now to FIG. 5, a fracturing chart showing tubing pressure, annulus pressure and fracturing fluid rate during a fracturing procedure carried out in accordance with the present invention is illustrated. Segment 1 of the chart illustrates the tubing and annulus pressure maintained for the detection of leaks and testing of the packer which is set at approximately 8132 feet below the surface. A tubing pressure of 1000 psi. is maintained with the annulus pressure being 150 psi.

Segment 2 shows the pumping of fracturing fluid into the lower end portion of the wellbore which causes an immediate increase in tubing pressure to the point of formation breakdown or fracturing. After fracturing the annulus pressure rises almost immediately indicating communication between the lower end portion of the wellbore and the annulus. The average pumping rate is 11 gallons per minute with breakdown taking place at a surface pressure of 2160 psi. corresponding to a downhole pressure of 8177 psi. After breakdown, pumping is continued for a short time, i.e., about 2 minutes, to extend the fracture.

Segment 3 of the chart shows a first shut-in period wherein the tubing pressure drops to about 925 psi. and the annulus pressure rises to about 525 psi. After stabilization, the tubing and annulus pressures remain constant at a pressure differential of about 400 psi. across the packer.

Segment 4 of the chart shows a second pumping of fracturing fluid at a rate of about 8 gallons per minute for a pumping time of about 2 minutes. Again, a clear communication between tubing and annulus is shown.

Segment 5 shows a second instantaneous shut-in pressure which, because the tubing and annulus pressure level stabilized indicates immediate fracture closure.

Segment 6 shows a third resumption of pumping of fracturing fluid at a rate of about 5 gallons per minute. Again, immediate communication between the lower end portion of the wellbore and the annulus occurs. Segment 7 shows a third shut-in.

The orientated core obtained from the bottom of the wellbore after fracturing in the above-described manner contains a downwardly extending portion of the created fracture. The fracture is vertical and extends 3.5 feet below the bottom of the wellbore. The orientation of the fracture in the formation is easily determined from the location orientated core.

What is claimed is:

1. A method of determining the orientation of one or more fractures created in a subterranean formation penetrated by a wellbore comprising:

creating a fracture in said formation extending from a lower end portion of said wellbore; and removing a location orientated core containing a portion of said fracture from said wellbore to thereby determine the orientation of said fracture in said formation.

2. The method of claim 1 wherein said fracture is created by applying hydraulic pressure on said formation.

3. The method of claim 2 wherein said hyraulic pressure is applied on said formation by pumping a fracturing fluid thereinto.

4. The method of claim 3 wherein said fracture extends through the bottom of said wellbore and said core is removed therefrom.

5. The method of claim 1 wherein the method is carried out during the drilling of said wellbore and said hydraulic pressure is applied on said formation by pumping drilling fluid thereinto.

6. A method of determining the orientation of fractures created in a subterranean formation penetrated by a wellbore comprising the steps of:

isolating a lower end portion of said wellbore whereby hydraulic pressure can be applied thereinto;

applying hydraulic pressure on said formation at said lower end portion of said wellbore to thereby form a fracture in said formation extending from said wellbore; and removing a location orientated core containing a portion of said fracture from said wellbore to thereby determine the orientation of said fracture in said formation.

7. The method of claim 6 wherein the step of isolating a lower end portion of said wellbore comprises setting a packer in said wellbore above said lower end portion of said wellbore with a conduit string extending therethrough.

8. The method of claim 7 wherein said hydraulic pressure is applied on said formation at the lower end portion of said wellbore by pumping a fracturing fluid therein by way of said conduit string.

9. The method of claim 8 wherein said fracturing fluid is drilling fluid and said conduit string is a drill pipe string.

10. The method of claim 6 wherein said fracture extends through the bottom of said wellbore and said core is removed therefrom.

11. A method of determining the orientation of hydraulic fractures in a subterranean formation during the drilling of a wellbore penetrating the formation comprising the steps of:

drilling said wellbore utilizing a string of drill pipe through which drilling fluid is pumped into but not through said formation;

isolating a lower end portion of said wellbore whereby hydraulic pressure can be applied to said formation by way of said string of drill pipe;

applying hydraulic pressure on said formation at said lower end portion of said wellbore to thereby form a fracture in said formation extending from said wellbore; and removing a location orientated core containing a portion of said fracture from said wellbore to thereby determine the orientation of said fracture in said formation.

12. The method of claim 11 wherein said hydraulic pressure is applied on said formation by pumping drilling fluid therein.

13. The method of claim 11 wherein said fracture extends through the bottom of said wellbore and said core is removed therefrom.

14. The method of claim 11 wherein the step of isolating a lower end portion of said wellbore comprises setting an open hole packer in said wellbore above said lower end portion thereof.

15. A method of determining the orientation of fractures created in two or more subterranean formations during the drilling of a wellbore penetrating said formations comprising the steps of:

(a) drilling said wellbore utilizing a string of drill pipe through which drilling fluid is pumped into but not through the uppermost of said formations;

(b) isolating a lower end portion of said wellbore whereby hydraulic pressure can be applied to said formation by way of said string of drill pipe;

(c) applying hydraulic pressure on said formation at said lower end portion of said wellbore to thereby form a fracture in said formation extending from said wellbore;

(d) removing a location orientated core containing a portion of said fracture from said wellbore to thereby determine the orientation of said fracture in said formation;

(e) drilling said wellbore into but not through the next of said formations;

(f) repeating steps (a) through (d);

(g) repeating steps (e) and (f) for additional formations; and then (h) utilizing the orientations of said fractures in said location orientated cores to determine the orientations of fractures in said formations.

16. The method of claim 15 wherein said hydraulic pressures are applied on said formations by pumping a fracturing fluid thereinto.

17. The method of claim 16 wherein said fracturing fluid is drilling fluid.

18. The method of claim 15 wherein said fractures extend through the bottom of the wellbore in each formation and said cores are removed therefrom.

19. The method of claim 15 wherein the steps of isolating lower end portions of said wellbore are each comprised of setting an open hole packer in said wellbore above the lower end portion thereof.

20. The method of claim 15 which is further chracterized to include the steps of determining the instantaneous shut-in pressures in said formations after creating fractures therein to thereby determine the least in situ principal stress levels of said formations.

* * * * *